US009312602B2

(12) United States Patent
Gregoire

(10) Patent No.: US 9,312,602 B2
(45) Date of Patent: Apr. 12, 2016

(54) CIRCULARLY POLARIZED SCALAR IMPEDANCE ARTIFICIAL IMPEDANCE SURFACE ANTENNA

(71) Applicant: HRL LABORATORIES LLC., Malibu, CA (US)

(72) Inventor: Daniel J. Gregoire, Thousand Oaks, CA (US)

(73) Assignee: HRL Laboratories, LLC, Malibu, CA (US)

( * ) Notice: Subject to any disclaimer, the term of this patent is extended or adjusted under 35 U.S.C. 154(b) by 182 days.

(21) Appl. No.: 14/092,276

(22) Filed: Nov. 27, 2013

(65) Prior Publication Data

US 2015/0145748 A1 May 28, 2015

(51) Int. Cl.

| | |
|---|---|
| ***H01Q 1/36*** | (2006.01) |
| ***H01Q 9/30*** | (2006.01) |
| ***H01Q 13/28*** | (2006.01) |
| ***H01Q 15/10*** | (2006.01) |
| ***H01Q 19/06*** | (2006.01) |

(52) U.S. Cl.

CPC ..... *H01Q 9/30* (2013.01); *H01Q 13/28* (2013.01); *H01Q 15/10* (2013.01); *H01Q 19/067* (2013.01); *Y10T 29/49016* (2015.01)

(58) Field of Classification Search

USPC ..... 343/700 MS, 895

See application file for complete search history.

(56) References Cited

U.S. PATENT DOCUMENTS

| | | | | |
|---|---|---|---|---|
| 4,630,064 | A * | 12/1986 | Andrews | H01Q 25/02 343/895 |
| 5,227,807 | A * | 7/1993 | Bohlman | H01Q 9/27 343/895 |
| 5,619,218 | A * | 4/1997 | Salvail | H01Q 1/36 343/895 |
| 5,712,647 | A * | 1/1998 | Shively | H01Q 9/27 343/700 MS |
| 6,369,778 | B1 * | 4/2002 | Dockery | H01Q 1/36 343/895 |
| 6,466,177 | B1 * | 10/2002 | Kunysz | H01Q 1/38 343/769 |
| 7,218,281 | B2 | 5/2007 | Sievenpiper | |
| 7,830,310 | B1 | 11/2010 | Sievenpiper | |
| 7,898,498 | B2 * | 3/2011 | Higashi | H01L 28/10 250/338.4 |

(Continued)

FOREIGN PATENT DOCUMENTS

| | | |
|---|---|---|
| JP | 05-199034 | 8/1993 |
| JP | 06-069717 | 3/1994 |

(Continued)

OTHER PUBLICATIONS

Felix K. Schwering et al., Design of Dielectric Grating Antennas for Millimeter-Wave Applications, IEEE Transactions on Microwave Theory and Techniques, IEEE Service Center, Piscataway, NJ, US, vol. MTT-31, No. 2, pp. 199-209 (Feb. 1, 1983).

(Continued)

*Primary Examiner* — Tan Ho

(74) *Attorney, Agent, or Firm* — Ladas & Parry

(57) ABSTRACT

A circularly polarized artificial impedance surface antenna (AISA) includes an impedance modulated substrate having a modulated scalar impedance to a surface wave traversing a top surface of the substrate, wherein the impedance modulation has a plurality of intertwined lines of constant impedance, and wherein each line of constant impedance follows a spiral elliptical path.

28 Claims, 8 Drawing Sheets

(56) References Cited

U.S. PATENT DOCUMENTS

| | | | |
|---|---|---|---|
| 7,911,407 | B1 | 3/2011 | Fong |
| 2007/0001909 | A1 | 1/2007 | Sievenpiper |
| 2009/0002240 | A1 | 1/2009 | Sievenpiper |
| 2010/0156749 | A1 | 6/2010 | Kim |
| 2011/0209110 | A1 | 8/2011 | Grbic et al. |
| 2012/0194399 | A1 | 8/2012 | Bily et al. |

FOREIGN PATENT DOCUMENTS

| | | |
|---|---|---|
| JP | 08-008638 | 1/1996 |
| JP | 07-142916 | 6/2005 |
| JP | 06-112730 | 4/2014 |
| KR | 10-2004-0026205 | 3/2004 |

OTHER PUBLICATIONS

Xu Shanjia et al. "Radiation Characteristics of Multilayer Periodic Dielectric Structures", International Journal of Infared and Millimeter Waves, Springer, Dordrecht, NL, vol. 11, No. 9, pp. 1047-1067 (Sep. 1, 1990).

Xu Shanjia et al., Effects of Groove Profile on the Performances of Grating Antennas, Merging Technologies for the 90's, [International Symposium on Antennas and Propagation], IEEE Dallas TX, vol. 4, pp. 1940-1943, (May 7-11, 1990).

EPO Search Report issued for EPO application No. 13763059.3 dated May 28, 2015.

From U.S. Appl. No. 13/427,682, Application and Office Actions including but not limited to the Office Action mailed on Jan. 30, 2014.

From U.S. Appl. No. 13/752,195, Application and Office Actions.

From U.S. Appl. No. 13/931,097, Application and Office Actions.

PCT International Preliminary Report on Patentability (Chapter II) mailed on Feb. 7, 2014 for related PCT Application No. PCT/US2013/031079.

PCT International Search Report and Written Opinion mailed on Jun. 27, 2013 for related PCT Application No. PCT/US2013/031079.

Colburn, "Scalar and Tensor Artificial Impedance Surface Conformal Antennas," 2007 Antenna Applications Symposium, pp. 526-540.

Collin, "Field theory of guided waves, 2nd Ed.", IEEE Press, 1996, pp. 705-708.

Fong, "Scalar and Tensor Holographic Artificial Impedance Surfaces," IEEE TAP., 58, 2010.

Gregoire and Colburn, *Artificial impedance surface antenna design and simulation*, Proc. Antennas Appl. Symposium 2010, pp. 288-303.

Gregoire and Colburn, *Artificial impedance surface antennas*, Proc. Antennas Appl. Symposium 2011, pp. 460-475.

Luukkonen et al, "Simple and accurate analytical model of planar grids and high-impedance surfaces comprising metal strips or patches", IEEE Trans. Antennas Prop., vol. 56, 1624, 2008.

Minatti and Maci et al, "Spiral Leaky-Wave Antennas Based on Modulated Surface Impedance", IEEE Trans. on Antennas and Propagation, vol. 59, No. 12, Dec. 2011.

Patel, A.M.; Grbic, A., "A Printed Leaky-Wave Antenna Based on a Sinusoidally-Modulated Reactance Surface," Antennas and Propagation, IEEE Transactions on , vol. 59, No. 6, pp. 2087,2096, Jun. 2011.

Sievenpiper et al, "Holographic AISs for conformal antennas", 29th Antennas Applications Symposium, 2005.

Sievenpiper, 2005 IEEE Antennas and Prop. Symp. Digest, vol. 1B, pp. 256-259, 2005.

International Search Report and Written Opinion from PCT/US2014/064404 mailed Feb. 13, 2015.

From U.S. Appl. No. 13/931,097 (unpublished; Non-publication request), Non-Final Office Action mailed Apr. 7, 2015.

* cited by examiner

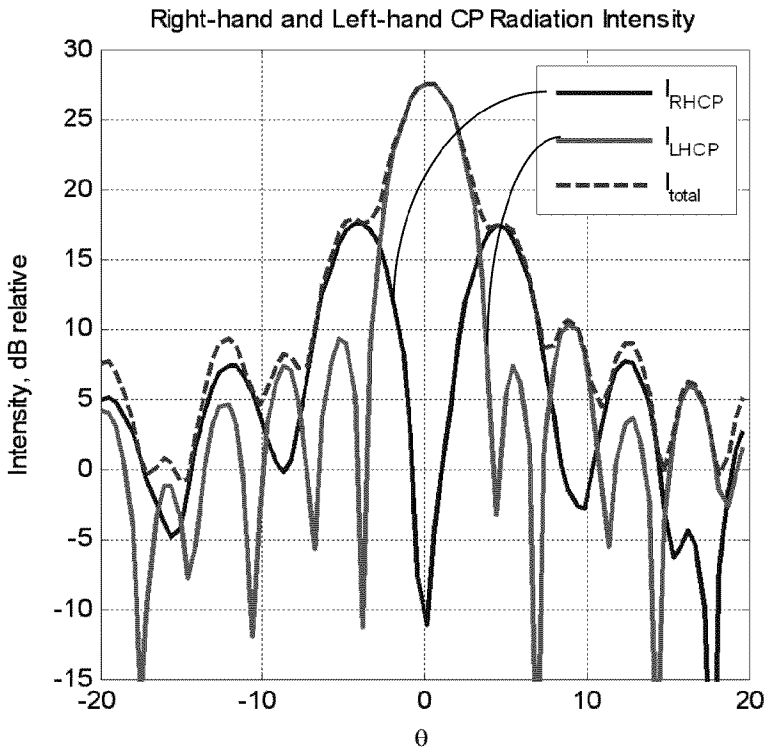
FIG. 2 Prior Art
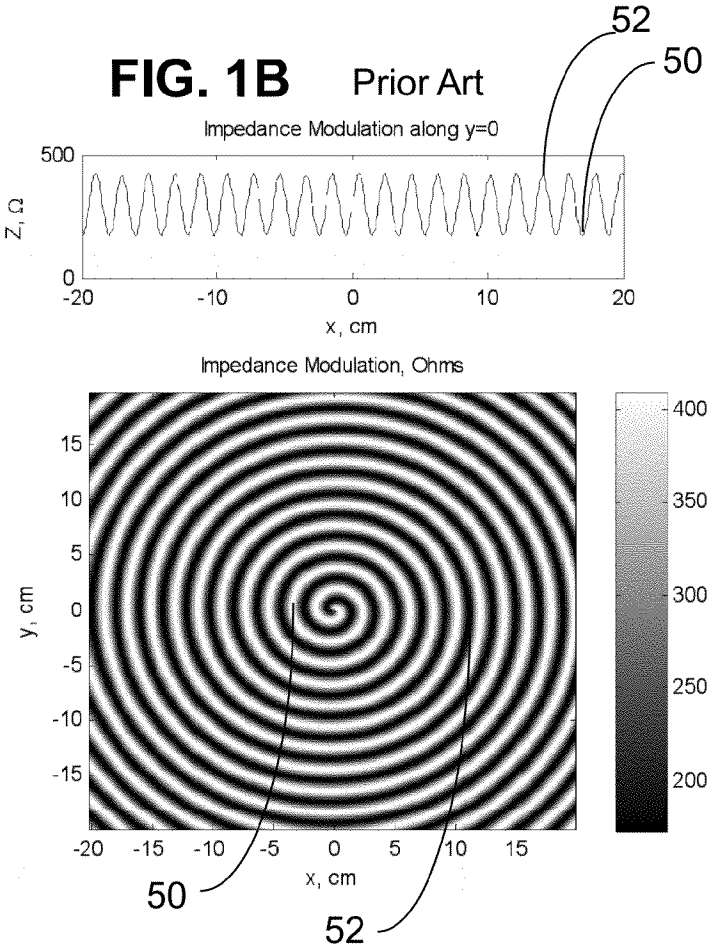
FIG. 1B Prior Art
FIG. 1A Prior Art

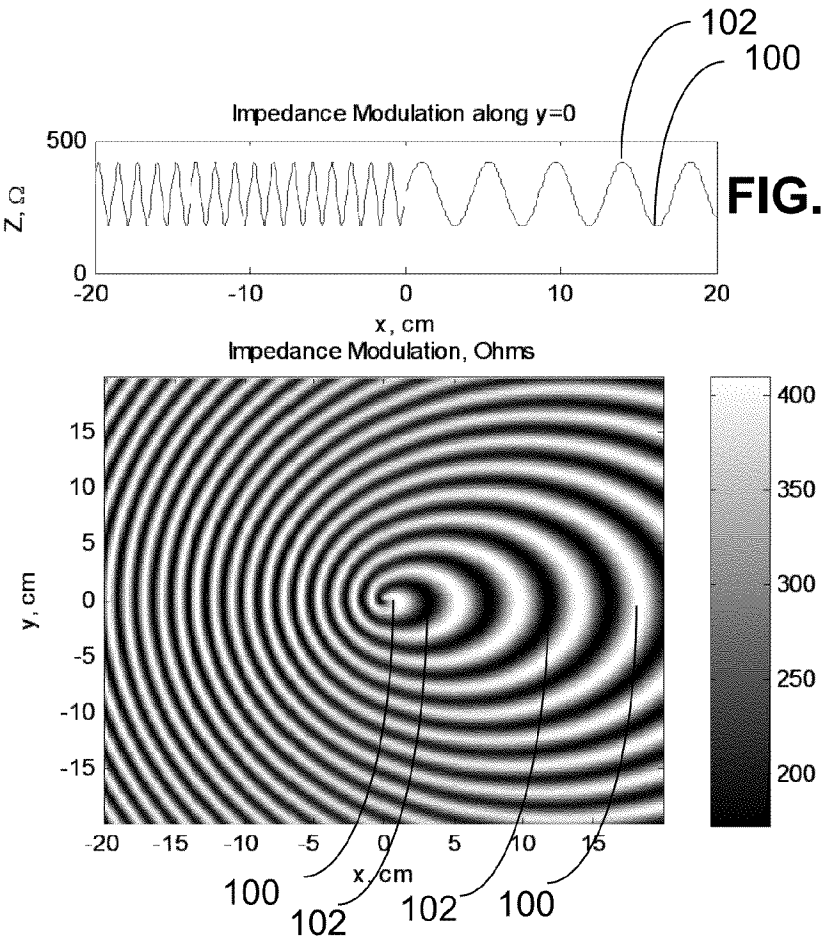
FIG. 3A
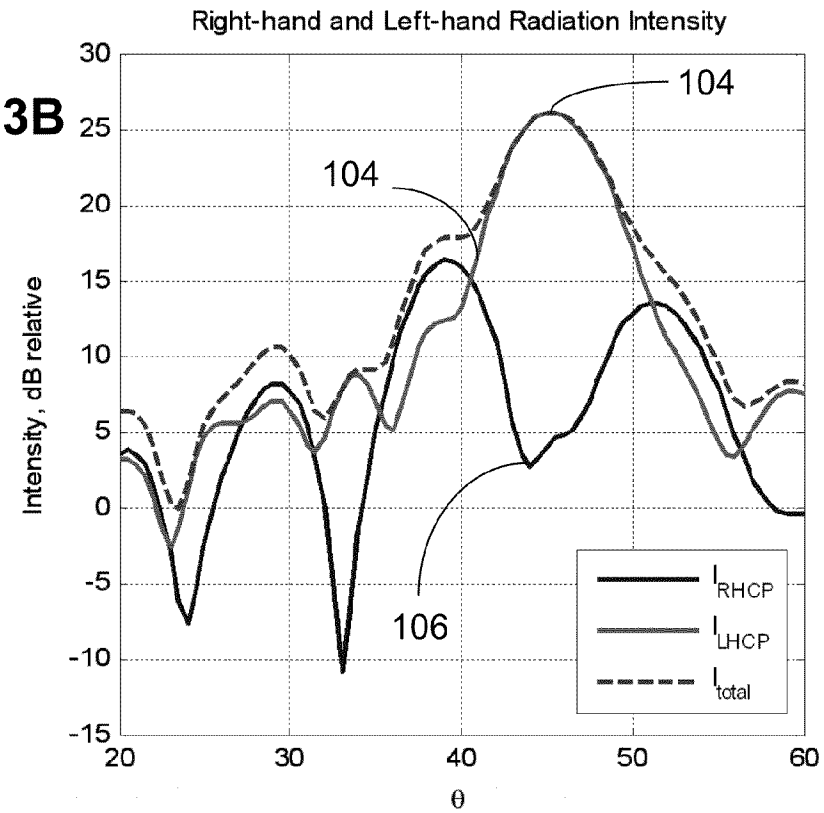
FIG. 3B
FIG. 3C

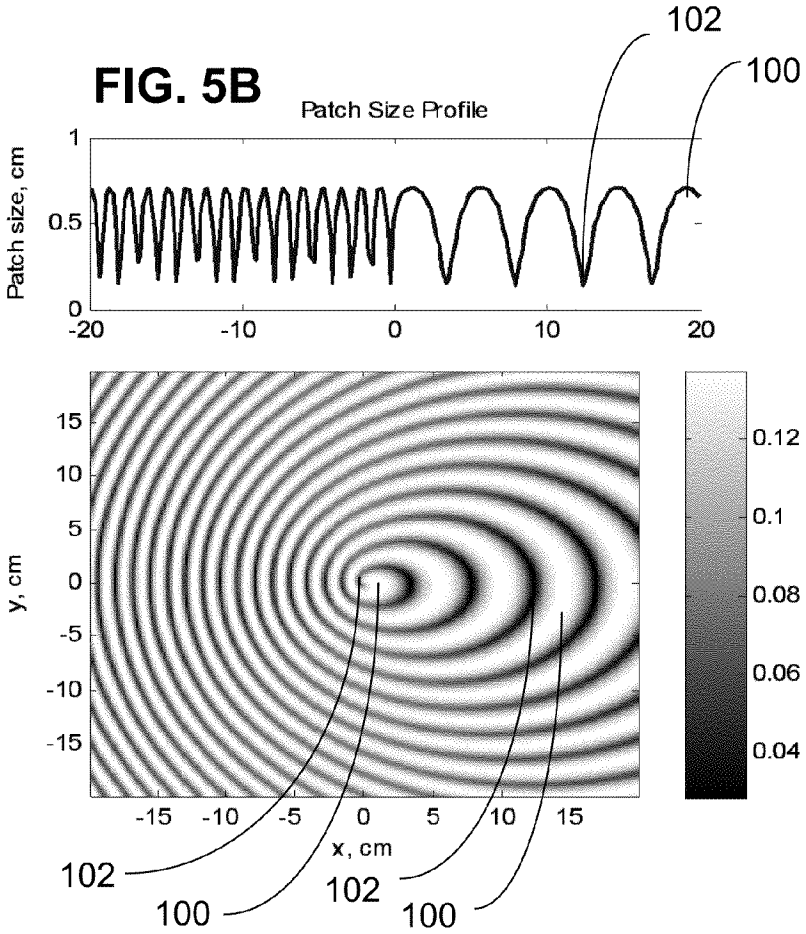
FIG. 5B
FIG. 5A
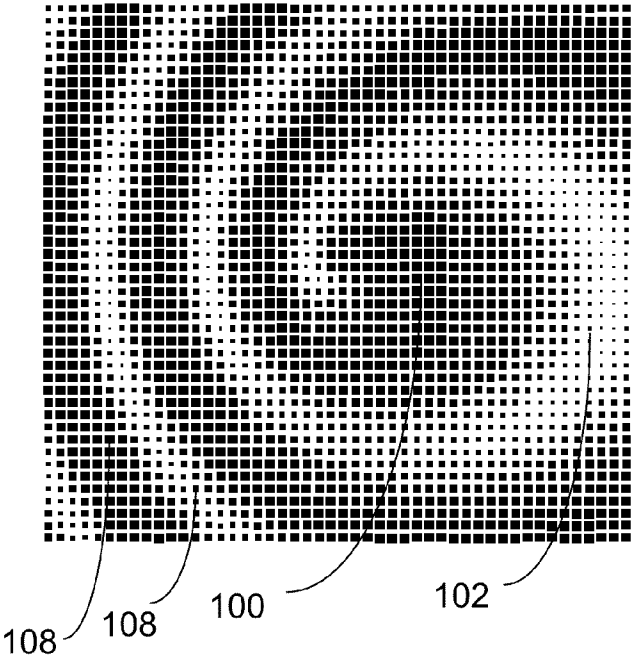
FIG. 5C

CIRCULARLY POLARIZED SCALAR IMPEDANCE ARTIFICIAL IMPEDANCE SURFACE ANTENNA

CROSS REFERENCE TO RELATED APPLICATIONS

This application is related to U.S. patent application Ser. No. 13/931,097, filed Jun. 28, 2013, U.S. patent application Ser. No. 13/752,195, filed Jan. 28, 2013, and U.S. patent application Ser. No. 13/427,682, filed Mar. 22, 2012, which are incorporated herein as though set forth in full.

STATEMENT REGARDING FEDERAL FUNDING

None

TECHNICAL FIELD

This disclosure relates to artificial impedance surface antennas (AISAs), and in particular to circularly polarized AISAs.

BACKGROUND

Artificial impedance surface antennas (AISAs) are realized by launching a surface wave across an artificial impedance surface (AIS), whose impedance is spatially modulated across the AIS according a function that matches the phase fronts between the surface wave on the AIS and the desired far-field radiation pattern.

In previous work described in references [1]-[6] below, artificial impedance surface antennas (AISA) are formed from modulated artificial impedance surfaces (AIS). Patel in reference [1] describes a scalar AISA using an endfire-flare-fed one-dimensional, spatially-modulated AIS consisting of a linear array of metallic strips on a grounded dielectric. Sievenpiper, Colburn and Fong in references [2]-[4] describe scalar and tensor AISAs on both flat and curved surfaces using waveguide- or dipole-fed, two-dimensional, spatially-modulated AISs consisting of a grounded dielectric topped with a grid of metallic patches. Gregoire in references [5]-[6] examined the dependence of AISA operation on the AISA's design properties.

The basic principle of AISA operation is to use the grid momentum of the modulated AIS to match the wavevector of an excited surface-wave (SW) front to a desired plane wave. In the one-dimensional case, this can be expressed as $$k_{sw}=k_o \sin\theta_o-k_p \tag{1}$$

where $k_o$ is the radiation's free-space wavenumber at the design frequency, $\theta_o$ is the angle of the desired radiation with respect to the AIS normal, $k_p=2\pi/p$ is the AIS grid momentum where p is the AIS modulation period, and $k_{sw}=n_o k_o$ is the surface wave's wavenumber, where $n_o$ is the surface wave's refractive index averaged over the AIS modulation. The surface wave (SW) impedance is typically chosen to have a pattern that modulates the SW impedance sinusoidally along the SW grid according to $$Z(x)=X+M\cos(2\pi x/p) \tag{2}$$

where p is the period of the modulation, X is the mean impedance, and M is the modulation amplitude. X, M and p are chosen such that the angle of the radiation θ in the x-z plane with respect to the z axis is determined by $$\theta=\sin^{-1}(n_0-\lambda_0/p) \tag{3}$$

where $n_0$ is the mean SW index, and $\lambda_0$ is the free-space wavelength of radiation. $n_0$ is related to Z(x) by $$n_0=\frac{1}{p}\int_0^p\sqrt{1+Z(x)^2}\,dx\approx\sqrt{1+X^2}. \tag{4}$$

The AISA impedance modulation of Eqn. (2) can be generalized for an AISA of any shape as $$Z=(\vec{r})X+M\cos(k_o n_o r-\vec{k}_o\square\vec{r}) \tag{5}$$

where $\vec{k}_o$ is the desired radiation wave vector, $\vec{r}$ is the three-dimensional position vector of the AIS, and r is the distance along the AIS from the surface-wave source to $\vec{r}$ along a geodesic on the AIS surface. This expression can be used to determine the index modulation for an AISA of any geometry, flat, cylindrical, spherical, or any arbitrary shape. In some cases, determining the value of r is geometrically complex. For a flat AISA, it is simply $r=\sqrt{x^2+y^2}$.

For a flat AISA (in the x-y plane), the radiation wavevector be assumed to radiate into the x-z plane $\vec{k}_o=k_o(\sin\theta_o\hat{x}+\cos\theta_o\hat{z})$ without loss of generality. Let the surface-wave source be located at x=y=0. Then, the modulation function is $$Z(x,y)=X+M\cos\gamma \tag{6}$$

$$\text{where } \gamma=k_o(n_o\rho-x\sin\theta_0) \tag{7}$$

and $\rho=\sqrt{x^2+y^2}$. The cos function in Eqns. (2), (5) and (6) can be replaced with any periodic function and the AISA will still operate as designed, but the properties of the radiation side lobes, bandwidth and beam squint will be affected.

The AIS can be realized as a grid of metallic patches on a grounded dielectric. The desired index modulation is produced by varying the size of the patches according to a function that correlates the patch size to the surface wave index. The correlation between index and patch size can be determined using simulations, calculation and/or measurement techniques. For example, Colburn in reference [3] and Fong in reference [4] use a combination of HFSS unit-cell eigenvalue simulations and near field measurements of test boards to determine their correlation function. Fast approximate methods presented by Luukkonen in reference [7] can also be used to calculate the correlation. However, empirical correction factors are often applied to these methods. In many regimes, these methods agree very well with HFSS eigenvalue simulations and near-field measurements. They break down when the patch size is large compared to the substrate thickness, or when the surface-wave phase shift per unit cell approaches 180°.

Circularly-Polarized AIS Antennas Using Modulated Tensor-Impedance

An AIS antenna can be made to operate with circularly-polarized (CP) radiation by using a modulated tensor-impedance surface whose impedance properties are anisotropic. Mathematically, the impedance is described at every point on the AIS by a tensor. In a generalization of the modulation function of equation (6) for the linear-polarized AISA as described in reference [4], the impedance tensor of the CP AISA may have a form like $$Z = \begin{bmatrix} X - M\cos\phi\cos\gamma & \frac{1}{2}M\sin(\gamma-\phi) \\ \frac{1}{2}M\sin(\gamma-\phi) & X + M\sin\phi\sin\gamma \end{bmatrix}; \quad (8)$$

where $\phi \equiv \tan^{-1}(y/x)$. (9)

In reference [4], the tensor impedance is realized with anisotropic metallic patches on a grounded dielectric substrate. The patches are squares of various sizes with a slice through the center of them. By varying the size of the patches and the angle of the slice through them, the desired tensor impedance of equation (8) can be created across the entire AIS. Other types of tensor impedance elements besides these sliced patches can be used to create the tensor AIS.

All-Dielectric AIS Antennas

All-dielectric AIS antennas have been demonstrated for linearly-polarized operation and described in reference [9]. Dielectric AIS antennas operate according to the same principle of the prior art AIS antennas described above except that the impedance is modulated by varying the thickness of the dielectric.

Scalar-Impedance, Circularly-Polarized, AIS Antennas Radiating at θ=0°

Circularly-polarized (CP) AIS antennas that radiate at θ=0° can be made with a modulated scalar impedance, as described in reference [8]. The impedance is modulated according to $$Z(x,y)=X+M\cos(\gamma\pm\phi) \quad (10)$$

where γ and ϕ have been defined in equations (7) and (9) respectively, and the ± sign corresponds to an antenna operating in right-hand CP (RHCP) or left-hand CP (LHCP) modes respectively. In appearance, the modulation looks like intertwined, circular spiral lines of constant impedance, such as lines 50 and 52 of low and high impedance, respectively, as shown in FIGS. 2A and 2B. Such an antenna will radiate in a beam perpendicular to the surface of the AIS (θ=0°), as shown in FIG. 2C.

Minatti and Maci in reference [8] deduced the impedance modulation of equation (10) through purely intuitive methods; however, they were unable to generalize it for an antenna radiating at an arbitrary angle.

REFERENCES

[1] Patel, A. M.; Grbic, A., "A Printed Leaky-Wave Antenna Based on a Sinusoidally-Modulated Reactance Surface," Antennas and Propagation, IEEE Transactions on, vol. 59, no. 6, pp. 2087, 2096, June 2011.

[2] D. Sievenpiper et al, "Holographic AISs for conformal antennas", 29th Antennas Applications Symposium, 2005.

[3] D. Sievenpiper, J. Colburn, B. Fong, J. Ottusch and J. Visher., 2005 IEEE Antennas and Prop. Symp. Digest, vol. 1B, pp. 256-259, 2005.

[4] B. Fong et al; "Scalar and Tensor Holographic Artificial Impedance Surfaces," IEEE TAP., 58, 2010.

[5] D. J. Gregoire and J. S. Colburn, *Artificial impedance surface antennas*, Proc. Antennas Appl. Symposium 2011, pp. 460-475.

[6] D. J. Gregoire and J. S. Colburn, *Artificial impedance surface antenna design and simulation*, Proc. Antennas Appl. Symposium 2010, pp. 288-303.

[7] O. Luukkonen et al, "Simple and accurate analytical model of planar grids and high-impedance surfaces comprising metal strips or patches", IEEE Trans. Antennas Prop., vol. 56, 1624, 2008.

[8] Minatti and Maci et al, "Spiral Leaky-Wave Antennas Based on Modulated Surface Impedance", IEEE Trans. on Antennas and Propagation, Vol. 59, No. 12, December 2011.

[9] U.S. patent application Ser. No. 13/427,682, filed Mar. 22, 2012 "Dielectric Artificial Impedance Surface Antenna.

What is needed is a circularly-polarized AIS antenna that can radiate at an arbitrary angle. The embodiments of the present disclosure answer these and other needs.

SUMMARY

In a first embodiment disclosed herein, a circularly polarized artificial impedance surface antenna (AISA) comprises an impedance modulated substrate having a modulated scalar impedance to a surface wave traversing a top surface of the substrate, wherein the impedance modulation has a plurality of intertwined lines of constant impedance, and wherein each line of constant impedance follows a spiral elliptical path.

In another embodiment disclosed herein, a method of fabricating a method of fabricating a circularly polarized artificial impedance surface antenna (AISA) comprises forming an impedance modulated substrate having a modulated scalar impedance to a surface wave traversing a top surface of the substrate, wherein the impedance modulation has a plurality of intertwined lines of constant impedance, and wherein each line of constant impedance follows a spiral elliptical path.

In yet another embodiment disclosed herein, a circularly polarized artificial impedance surface antenna (AISA) comprises an impedance modulated substrate having a modulated scalar impedance to a surface wave traversing a top surface of the substrate, wherein the modulated scalar impedance pattern is $$Z(x, y) = X + M\left(\frac{\sin\gamma\cos\phi}{\cos\theta_0} \pm \cos\gamma\sin\phi\right)$$

where X is the mean impedance, where M is the modulation amplitude, where $\theta_0$ is the elevation angle of maximal gain with respect to a normal to the AISA, where $\gamma \equiv k_0(n_0\rho - x\sin\theta_0)$ $k_o$ is a radiation's free-space wavenumber at a design frequency, $n_o$ is a surface wave's refractive index averaged over the scalar impedance pattern, and $\rho=\sqrt{x^2+y^2}$, where $$\tan\phi \equiv \frac{y}{x},$$

where the ± sign corresponds to the AISA operating in a right hand circularly polarized (RHCP) or left hand circularly polarized (LHCP) modes, respectively, and where X and M vary with ρ, the distance from the surface-wave source.

In still another embodiment disclosed herein, a method of fabricating a circularly polarized artificial impedance surface antenna (AISA) comprises an impedance modulated substrate having a modulated scalar impedance to a surface wave traversing a top surface of the substrate, wherein the modulated scalar impedance pattern is $$Z(x, y) = X + M\left(\frac{\sin\gamma\cos\phi}{\cos\theta_0} \pm \cos\gamma\sin\phi\right)$$

where X is the mean impedance, where M is the modulation amplitude, where $\theta_0$ is the elevation angle of maximal gain with respect to a normal to the AISA, where $\gamma \equiv k_0(n_o\rho - x \sin\theta_0)$ $k_o$ is a radiation's free-space wavenumber at a design frequency, $n_o$ is a surface wave's refractive index averaged over the scalar impedance pattern, and $\rho = \sqrt{x^2+y^2}$, where $$\tan\phi \equiv \frac{y}{x},$$

where the ± sign corresponds to the AISA operating in a right hand circularly polarized (RHCP) or left hand circularly polarized (LHCP) modes, respectively, and where X and M vary with ρ, the distance from the surface-wave source.

These and other features and advantages will become further apparent from the detailed description and accompanying figures that follow. In the figures and description, numerals indicate the various features, like numerals referring to like features throughout both the drawings and the description.

BRIEF DESCRIPTION OF THE DRAWINGS

FIGS. 1A and 1B show an impedance pattern for a circularly-polarized scalar-impedance AISA radiating at θ=0°, and FIG. 2 shows the simulated right-hand circularly-polarized (CP) and left-hand CP radiation intensity for the AISA of FIG. 1A in accordance with the prior art;

FIG. 3A shows an impedance pattern for a left hand circularly polarized AISA, FIG. 3B shows the impedance modulation for FIG. 3A along y=0, and FIG. 3C shows the simulated radiation pattern for the AISA of FIG. 3A in accordance with the present disclosure;

FIG. 5A shows the impedance element patch size distribution for the AISA of FIG. 3A when it is fabricated as a grounded dielectric with square metallic patches, FIG. 5B show the patch size profile along y=0, and FIG. 5C shows a detail of the patches showing how their size varies with position in accordance with the present disclosure;

DETAILED DESCRIPTION

Figure 4B:
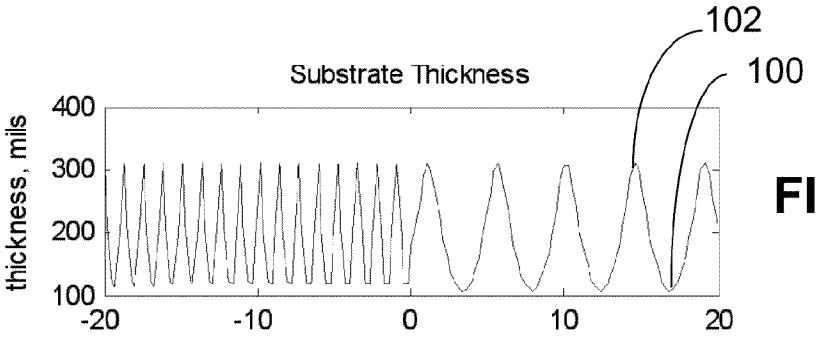
FIG. 4B shows the substrate thickness along y=0.

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

A circularly-polarized, scalar-impedance Artificial Impedance Surface Antenna (AISA) is disclosed that can be configured to radiate in a beam directed at an arbitrary angle. The AISA of the present disclosure has intertwined, elliptical spiral lines of constant impedance ranging from low and to high impedance, rather than the circular spiral lines, such as lines 50 and 52, as shown in FIG. 2A for the prior art. Further, because the AISA of the present disclosure uses a scalar impedance surface instead of a tensor impedance, it can be fabricated using any of the means used in the prior art discussed above, including modulating the thickness of a dielectric substrate, or configuring metallic patches of various size on a dielectric substrate.

FIG. 3A shows an impedance pattern for a 20-cm×20-cm, left hand circularly polarized (LHCP) AISA according to the present disclosure. The AISA of FIG. 3A has intertwined, elliptical spiral lines of constant impedance, such as lines 100 and 102 of low and high impedance, respectively. The AISA of FIG. 3A is configured to radiate at θ=45° at 12 GHz. The impedance of the elliptical spiral lines of constant impedance along y=0, as shown in FIG. 3B, ranges between a complex impedance 172 jΩ) and a complex impedance 421 jΩ, and generally has a sinusoidal form between the lowest and highest impedance. As shown in FIGS. 3A and 3B, the impedance modulation has lines of constant impedance that follow spiral elliptical paths. FIG. 3C shows the simulated radiation pattern for the AISA of FIG. 3A for f=12 GHz, and ϕ=0°. At the design angle of θ=45°, the LHCP radiation 104 is more than 20 dB greater than the RHCP radiation 106 at θ=45°. The radiation for the design of FIG. 3A is θ=45°; however the AISA may be configured to radiate with circular polarization at an arbitrary angle.

Figure 8B:
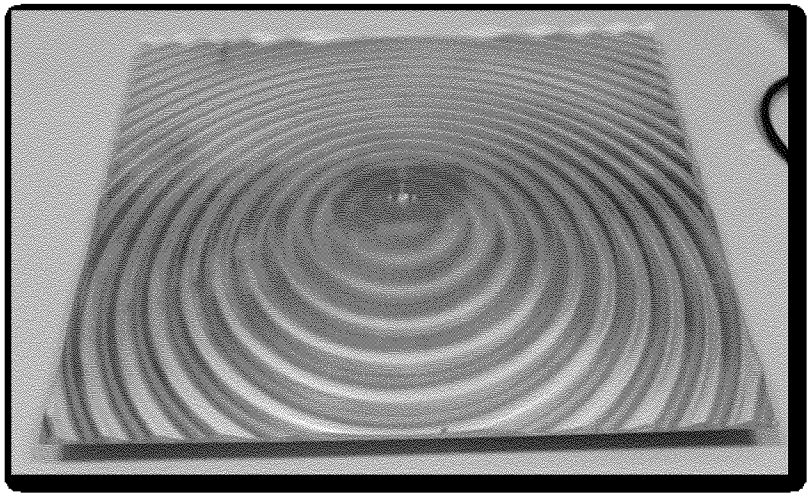
FIG. 8B shows a fabricated antenna whose impedance increases monotonically with ρ in accordance with the present disclosure.
Figure 8A:
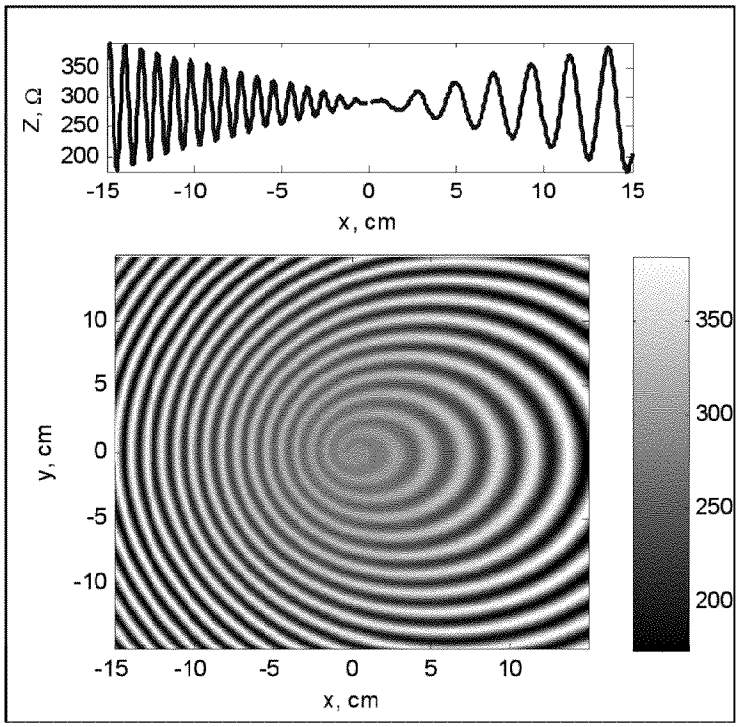
FIG. 8A shows an impedance pattern and impedance modulation where the intertwined elliptical lines are not constant impedance as in FIG. 3A, but whose impedance increases monotonically with ρ in accordance with the present disclosure.
Figure 8D:
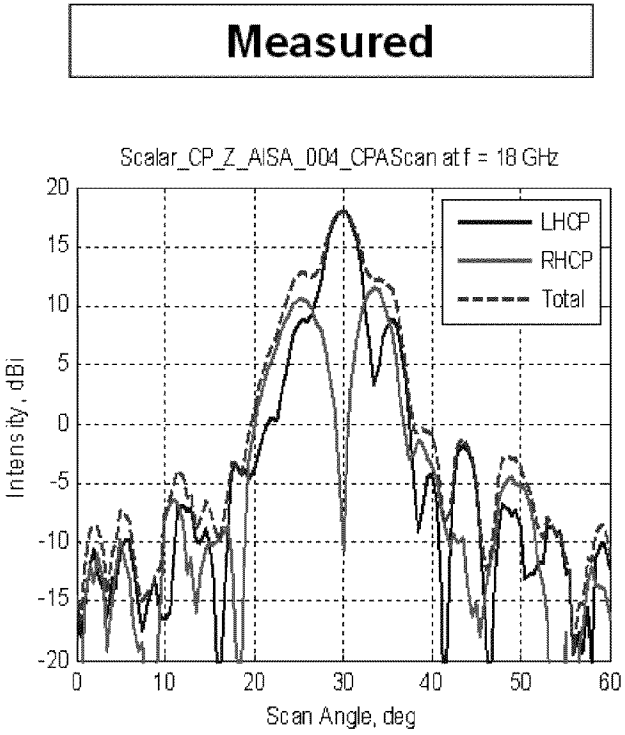
FIGS. 8C and 8D show the simulated and measured radiation for the antenna of FIG. 8B.
Figure 8C:
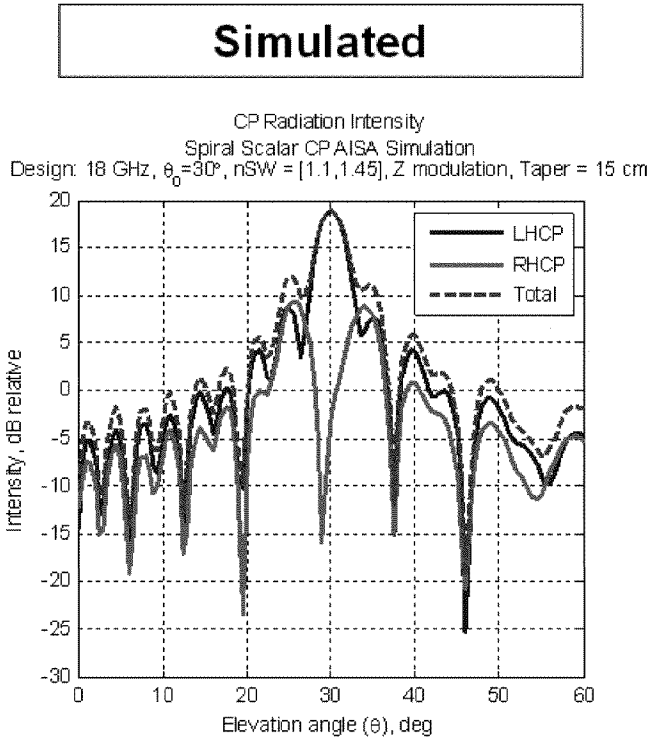

In another embodiment, the elliptical lines of intertwined impedance are not constant impedance, but may vary with their distance from the surface-wave source. FIG. 8A shows an impedance pattern and impedance modulation where the intertwined elliptical lines are not constant impedance as in FIG. 3A, but whose impedance increases monotonically with ρ in accordance with the present disclosure, FIG. 8B shows a fabricated antenna whose impedance increases monotonically with ρ in accordance with the present disclosure; and FIGS. 8C and 8D show the simulated and measured radiation for the antenna of FIG. 8B.

Figure 4A:
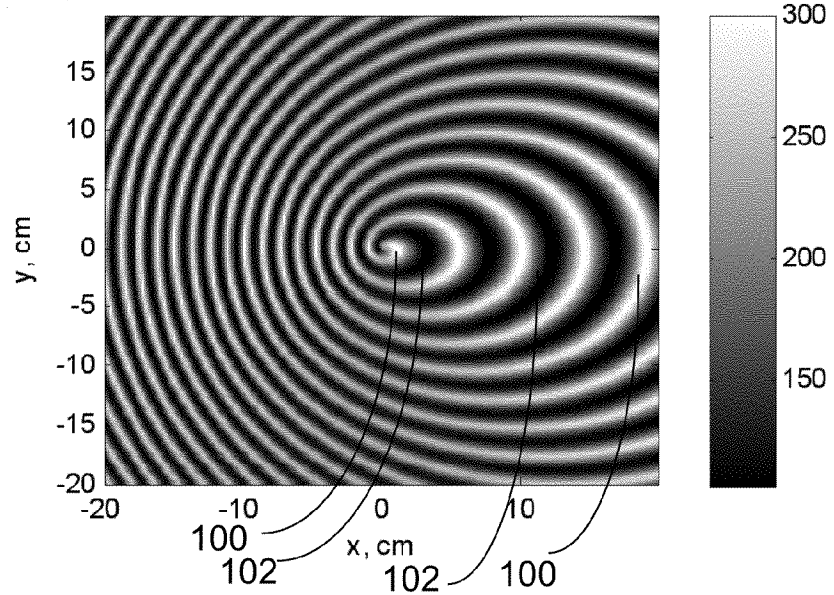
FIG. 4A shows the substrate thickness profile for the AISA of FIG. 3A when realized as a grounded dielectric with modulated thickness.
Figure 4C:
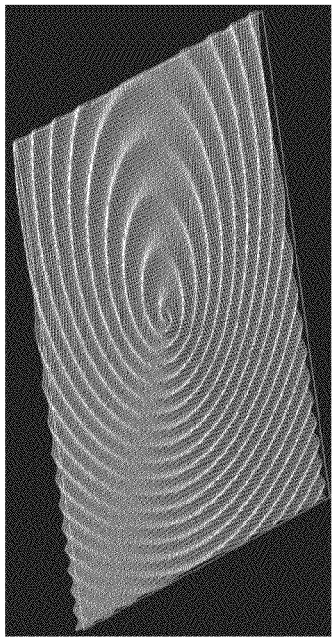
FIG. 4C shows an isometric view of the AISA's thickness modulation in accordance with the present disclosure.

FIG. 4A shows the thickness modulation for the AISA of FIG. 3A, when the AISA is realized as a grounded dielectric with a modulated thickness between a top surface and a bottom surface. The dielectric may be grounded with a ground plane on the bottom surface of the dielectric. The dielectric may be a non-conducting material, such as Lexan®, acrylic, plastic or Plexiglas®. For a Plexiglas® substrate with E=2.55, the thickness modulation of FIG. 4A along y=0 has a thickness ranging from 0.110 inches to 0.306 inches, as shown in FIG. 4B. FIG. 4C shows an isometric view of the thickness modulation.

FIG. 5A shows the impedance element patch size distribution for the AISA embodiment of FIG. 3A when the AISA is fabricated as a grounded dielectric with square metallic patches on the surface of the dielectric. The square metallic patches 108 may be printed or formed by using integrated circuit masking and deposition techniques on the surface of the dielectric. In this embodiment the AISA may have a substantially flat top and flat bottom surface and the thickness of the dielectric may be substantially constant across the AISA. The patch size varies with the position in the AISA to make elliptical spiral lines of constant impedance, such as lines 100 and 102 of low and high impedance, respectively. FIG. 5B shows the patch size profile along y=0. In one embodiment, the substrate may be a 50-mil thick Rogers® RO3010™ with ∈=11.2, and the patches may be distributed on a rectangular grid, as shown in FIG. 5C, with a period or distance between centers of adjacent patches on the rectangular grid of 1.5 mm. The relationship between patch size and the surface-wave impedance is well documented in the prior art references [1]-[8]. FIG. 5C shows a detail of how the patch size of each individual patch 108 varies with position in the AISA. As shown in FIG. 5C, a larger patch 108 size corresponds to a lower impedance and a smaller patch 108 size corresponds to a higher impedance.

Figure 6:
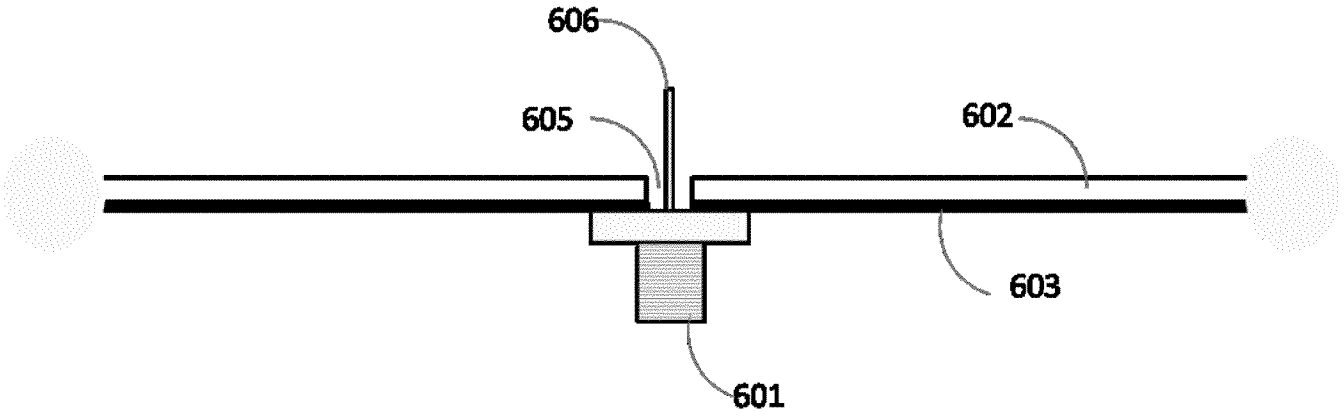
FIG. 6 Prior Art
FIG. 6 shows a surface-wave feed for an AISA in accordance with the prior art.

FIG. 6 shows one method of connecting the AISA to a radio frequency (RF) receiver/transmitter system. A surface-mount coaxial connector 601 is attached to the ground plane 603 of the AISA. The connector's center conductor 606 extends through a hole 605 in the AISA substrate 602. For example, referring to FIGS. 3A, 4A and 5A, the connector's center conductor 606 extends through a hole at the x=0, y=0 location of the dielectric, which may correspond to the center of the AISA substrate 602. The x=0, y=0 location of the dielectric, as shown in FIG. 3A, corresponds to the x=0, and y=0 location on the substrate for equation (11) below.

The length of the connector's center conductor 606 preferably has a length approximately one quarter (¼) wavelength of the surface wave from the ground plane. For a 12 GHz AISA, the length of the center conductor 606 is approximately 0.63 cm. This method of connecting to the AISA and other methods are well documented in the prior art [1]-[8]. A surface wave may be excited on the surface of the AISA by applying a radio frequency signal to the coaxial connector 601. A surface wave is generated and propagates radially outward from the surface wave coupler when the AISA is used in the transmit mode. When the AISA is used in the receive mode, the surface wave propagates inward towards the surface wave coupler.

The surface wave may also be transmitted or received by other forms of surface wave feeds coupled to the x=0, y=0 location on of the dielectric substrate. For example, the surface wave feed may be a micro-strip line, a waveguide, a microwave horn, or a dipole.

The impedance pattern of the AISA of the present disclosure is modulated according to equation (11):

$$Z(x, y) = X + M\left(\frac{\sin\gamma\cos\phi}{\cos\theta_0} \pm \cos\gamma\sin\phi\right) \tag{11}$$

where X is the mean impedance;

where M is the modulation amplitude;

where $\theta_0$ is the elevation angle of maximal gain with respect to a normal to the AISA;

where $\gamma \equiv k_0(n_0\rho - x\sin\theta_0)$;

$k_o$ is a radiation's free-space wavenumber at a design frequency;

$n_o$ is a surface wave's refractive index averaged over the scalar impedance pattern;

and $\rho = \sqrt{x^2+y^2}$ where $$\tan\phi \equiv \frac{y}{x};$$

and where the ± sign corresponds to the AISA operating in a right hand circularly polarized (RHCP) or left hand circularly polarized (LHCP) modes, respectively.

In some embodiments, X and M may vary with ρ, the distance from the surface-wave source. In one embodiment, M increases monotonically with ρ in order to maximize the antenna's aperture efficiency. This technique of tapering the impedance modulation amplitude is well known in the state of the prior art.

Equation (11) reduces to equation (10), when θ=0° for the circularly-polarized AIS antennas of the prior art with circular spiral arms of low and high impedance, as shown in FIG. 2A.

The impedance pattern for the AISA of the present disclosure, as described above, is a pair of intertwined, elliptical spiral arms 100 and 102, as shown in FIG. 3A.

The following describes a method for deriving impedance patterns for AISAs of the present disclosure.

AISA radiation is due to the surface wave (SW) current distribution according to the far-field radiation integral $$E_{rad}(k) \propto \int_{AISl}\{\hat{k}\times J_{sw}(r')\}\times\hat{k}]e^{-ik\square r'}d^2r', \tag{12}$$

where $E_{rad}(k)$ is the radiation's electric field in the far-field, $J_{SW}$ is the surface-wave current density, k is the radiation wavevector that designates both the radiation's direction and frequency, and r' is a point on the AIS.

When the left side of equation (12) is a desired antenna pattern, then the AIS impedance modulation that produces that pattern can be found by finding the surface-wave current that maximizes the integral on the right side of equation (12). One way the integral can be maximized is by setting the argument of the integral to be proportional to a desired radiation's polarization vector when $k=k_0$. Another way to maximize the integral is to require that the integral's argument when summed over a set of points on the AIS surface that are related by symmetry be likewise proportional to the radiation's polarization vector.

If an AISA is designed to have peak gain for a radiation wavevector $k=k_0$ and polarization $p_{rad}=p_\theta\hat{\theta}_0+p_\phi\hat{\phi}_0$, then the field at the frequency of and in the direction of $k_0$ is proportional to $$E_{rad} \propto p_{rad}e^{jk_0\square r}. \tag{13}$$

The surface wave (SW) impedance modulation is represented by the admittance tensor $Y_{sw}$. The SW current is related to the SW field $E_{sw}$ through $Y_{sw}$, and $E_{sw}$ is defined by its phase $\Phi_{sw}$ and polarization $p_{sw}$, $$J_{SW}=Y_{SW}E_{sw} \propto Y_{SW}e^{i\phi_{swp}}{}_{sw}, \tag{14}$$

where $\Phi_{sw}$ is a function of the SW propagation path and the impedance along the path.

$Y_{sw}$ is purely susceptive, and is decomposed into a constant part and a modulated part $$Y_{sw}=iBI+i\delta BIm(Q_{sw}), \tag{15}$$

where B is the mean susceptance, I is the identity matrix, δB is the modulation amplitude, and $Q_{sw}$ is the modulation tensor. When equations (13) and (14) are substituted into (12), the integral can be separated into three integrals that are proportional to B, $Q^*_{sw}$ and $Q_{sw}$ respectively. Only the last integral is non-vanishing.

The radiation integral (12) is maximized when its argument is unity. Then for radiation at $k_0$ and $p_{rad}$ $$(\hat{k}_0 \times J_{sw}) \times \hat{k}_0 \propto p_{rad} e^{ik_0 \hat{r} \cdot r}. \tag{16}$$

This condition requires every point on the AIS to contribute equally to the radiation field and is therefore dubbed the strong condition. Combining (12)-(14) gives the strong condition for the modulation tensor, $$Q_{sw} p_{sw} \propto e^{-i\Gamma} p'_{rad} \tag{17}$$

where $\Gamma$ is the modulation parameter $$\Gamma = \Phi_{sw} - k_0 \hat{r} \cdot r \tag{18}$$

and $p'_{rad}$ is defined here as the modified polarization vector $$p'_{rad} \equiv (p_\theta / \cos\theta_0 \hat{x} + p_\phi \hat{y}) \tag{19}$$

In one embodiment, an AISA is a planar AISA confined to x-y plane with transverse-magnetic (TM) SWs radiating from a source at the origin. In this AISA configuration, the SW polarization vector is $p_{sw} = \rho$ where $\rho$ is a unit vector in cylindrical coordinates on the AIS surface; it is also the surface tangent along the SW path.

The SW phase, $\Phi_{sw}$, is $$\Phi_{sw}(r) = k_0 \int_0^\rho n_{sw}(r') d\rho' \tag{20}$$

where $n_{sw}$ is the effective SW index. If the variation in $n_{sw}$ is ignored, then the modulation parameter of equation (18) may be approximated as $$\Gamma \cong k_0 n_0 \rho - k_0 \hat{r} \cdot r \equiv \gamma. \tag{21}$$

where $\gamma$ is defined in equation (7).

The impedance pattern for the present disclosure may be derived from the above analysis by applying the second condition for maximizing the radiation integral. This so-called weak condition results by replacing the integral with a sum over a set of points related by symmetry. Then equation (17) may be rewritten as $$\sum_{n=1}^{N} Q_{sw}(\rho_n) p_{sw}(\rho_n) e^{i\gamma(\rho_n)} \propto p'_{rad}. \tag{22}$$

Equation (22) may be used to derive the impedance modulation for the present disclosure by choosing the set of symmetry-related points to be $\rho_n = \{(\rho,\phi),(\rho,\phi+\pi/2)\}$, and the circular polarization to be $(p_\theta = 1, p_\phi = \pm i)$. Then equation (22) yields for the modulation parameter $$Q_{sw} = e^{-i\gamma}\left(\frac{\sin\gamma\cos\phi}{\cos\theta_0} \pm \cos\gamma\sin\phi\right). \tag{23}$$

and the impedance modulation is as expressed in equation (11).

One skilled in the art will notice that the above derivation assumes an admittance modulation while equation (11) is an impedance modulation. For the sake of brevity and clarity, the details of how the modulation is converted from the admittance formulation of (15) to the impedance formulation of (11) has been omitted; however those skilled in the art would understand the details, and would understand that the functional forms of the two modulation formulations are approximately identical when the modulation depth is small.

Figure 7:
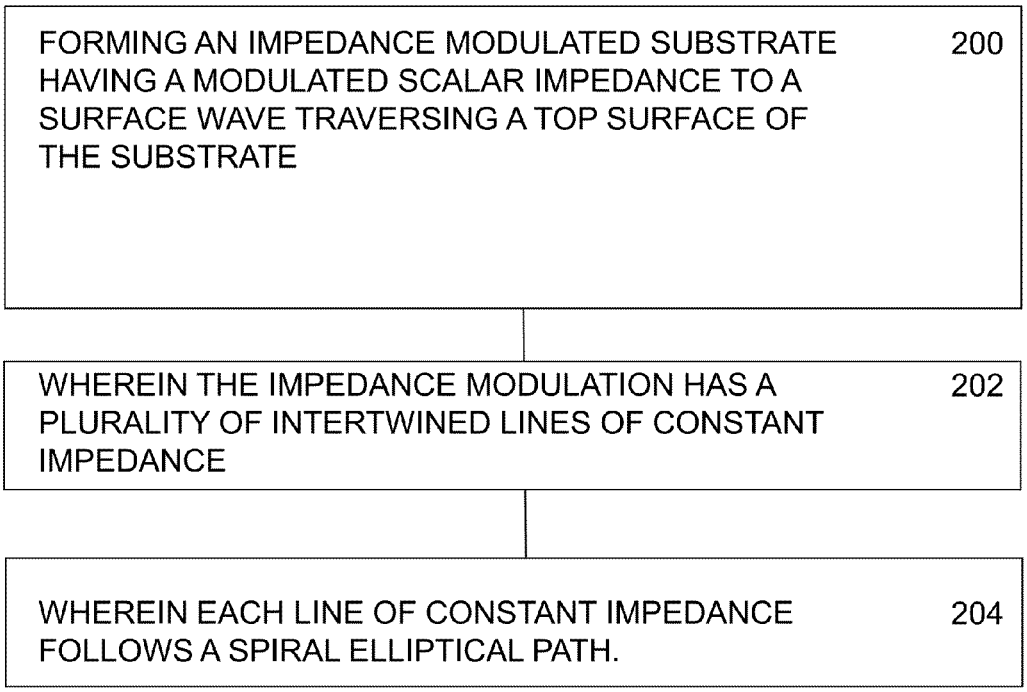
FIG. 7 shows a flow diagram for a method of forming an AISA in accordance with the present disclosure.

FIG. 7 shows a flow diagram for a method for making an AISA in accordance with the present disclosure. In step 200 an impedance modulated substrate is formed having a modulated scalar impedance to a surface wave traversing a top surface of the substrate. The impedance modulation has a plurality of intertwined lines of constant impedance as shown in step 202, and each line of constant impedance follows a spiral elliptical path, as shown in step 204.

Having now described the invention in accordance with the requirements of the patent statutes, those skilled in this art will understand how to make changes and modifications to the present invention to meet their specific requirements or conditions. Such changes and modifications may be made without departing from the scope and spirit of the invention as disclosed herein.

The foregoing Detailed Description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the Claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "comprising the step(s) of . . . . "

What is claimed is:

1. A circularly polarized artificial impedance surface antenna (AISA) comprising:

an impedance modulated substrate having a modulated scalar impedance to a surface wave traversing a top surface of the substrate;

wherein the impedance modulated substrate has a plurality of intertwined lines of constant impedance; and wherein each line of constant impedance follows a spiral elliptical path.

2. The circularly polarized artificial impedance surface antenna (AISA) of claim 1 wherein:

the impedance modulated substrate comprises a dielectric having the top surface and a bottom surface;

wherein the thickness varies between the top and the bottom surface to vary the impedance.

3. The circularly polarized artificial impedance surface antenna (AISA) of claim 2 further comprising:

a ground plane on the bottom surface.

4. The circularly polarized artificial impedance surface antenna (AISA) of claim 2 wherein:

the top surface has a modulated height; and the bottom surface is substantially flat.

5. The circularly polarized artificial impedance surface antenna (AISA) of claim 2 wherein:

the dielectric material comprises acrylic or plastic.

6. The circularly polarized artificial impedance surface antenna (AISA) of claim 1 wherein:

the impedance modulated substrate comprises a dielectric having the top surface and a bottom surface; and the AISA further comprises metallic patches of varying size on the top surface of the dielectric to vary the impedance.

7. The circularly polarized artificial impedance surface antenna (AISA) of claim 6 further comprising:

a ground plane on the bottom surface.

8. The circularly polarized artificial impedance surface antenna (AISA) of claim 6 wherein:

the top surface is substantially flat; and the bottom surface is substantially flat.

9. The circularly polarized artificial impedance surface antenna (AISA) of claim 6 wherein:

the dielectric material comprises acrylic or plastic.

10. The circularly polarized artificial impedance surface antenna (AISA) of claim 1 wherein:

the AISA has a substantially planar shape; and the AISA has a gain pattern with a higher gain at an angle θ with respect to a normal to the planar shape.

11. The circularly polarized artificial impedance surface antenna (AISA) of claim 1 wherein:

the modulated scalar impedance pattern is $$Z(x, y) = X + M\left(\frac{\sin\gamma\cos\phi}{\cos\theta_0} \pm \cos\gamma\sin\phi\right);$$

where X is the mean impedance;

where M is the modulation amplitude;

where $\theta_0$ is the elevation angle of maximal gain with respect to a normal to the AISA;

where $\gamma \equiv k_0(n_0\rho - x\sin\theta_0)$;

$k_o$ is a radiation's free-space wavenumber at a design frequency;

$n_o$ is a surface wave's refractive index averaged over the scalar impedance pattern;

and $\rho = \sqrt{x^2+y^2}$;

where $$\tan\phi \equiv \frac{y}{x};$$

and where the ± sign corresponds to the AISA operating in a right hand circularly polarized (RHCP) or left hand circularly polarized (LHCP) modes, respectively.

12. The circularly polarized artificial impedance surface antenna (AISA) of claim 11 further comprising:

a surface wave feed coupled to the substrate at the x=o, y=0 location on the substrate.

13. The circularly polarized artificial impedance surface antenna (AISA) of claim 12 wherein:

the surface wave propagates radially outward from the surface wave feed when the AISA is used in a transmit mode.

14. The circularly polarized artificial impedance surface antenna (AISA) of claim 12 wherein:

the surface wave propagates radially inward towards the surface wave feed when the AISA is used in a receive mode.

15. The circularly polarized artificial impedance surface antenna (AISA) of claim 12 wherein:

the surface wave feed comprises a coaxial connector coupled to the substrate.

16. The circularly polarized artificial impedance surface antenna (AISA) of claim 12 wherein:

the surface wave feed comprises a microstrip line, a waveguide, a microwave horn, or a dipole.

17. A method of fabricating a circularly polarized artificial impedance surface antenna (AISA) comprising:

forming an impedance modulated substrate having a modulated scalar impedance to a surface wave traversing a top surface of the substrate;

wherein the impedance modulated substrate has a plurality of intertwined lines of constant impedance; and wherein each line of constant impedance follows a spiral elliptical path.

18. The method of claim 17 wherein:

the impedance modulated substrate comprises a dielectric having the top surface and a bottom surface;

wherein the thickness varies between the top and the bottom surface.

19. The method of claim 18 further comprising:

forming a ground plane on the bottom surface.

20. The method of claim 17 wherein:

the impedance modulated substrate comprises a dielectric having the top surface and a bottom surface; and the method comprises forming metallic patches of varying size on the top surface of the dielectric.

21. The method of claim 20 further comprising:

forming a ground plane on the bottom surface.

22. The method of claim 17 wherein:

the modulated scalar impedance pattern is $$Z(x, y) = X + M\left(\frac{\sin\gamma\cos\phi}{\cos\theta_0} \pm \cos\gamma\sin\phi\right);$$

where X is the mean impedance;

where M is the modulation amplitude;

where $\theta_0$ is the elevation angle of maximal gain with respect to a normal to the AISA;

where $\gamma \equiv k_0(n_0\rho - x\sin\theta_0)$;

$k_o$ is a radiation's free-space wavenumber at a design frequency;

$n_o$ is a surface wave's refractive index averaged over the scalar impedance pattern;

and $\rho = \sqrt{x^2+y^2}$;

where $$\tan\phi \equiv \frac{y}{x};$$

and where the ± sign corresponds to the AISA operating in a right hand circularly polarized (RHCP) or left hand circularly polarized (LHCP) modes, respectively.

23. The method of claim 22 further comprising:

coupling a surface wave feed to the substrate at the x=o, y=0 location on the substrate.

24. The method of claim 23 wherein:

the surface wave feed comprises a coaxial connector coupled to the substrate.

25. A circularly polarized artificial impedance surface antenna (AISA) comprising:

an impedance modulated substrate having a modulated scalar impedance to a surface wave traversing a top surface of the substrate;

wherein the modulated scalar impedance pattern is $$Z(x, y) = X + M\left(\frac{\sin\gamma\cos\phi}{\cos\theta_0} \pm \cos\gamma\sin\phi\right);$$

where X is the mean impedance;

where M is the modulation amplitude;

where $\theta_0$ is the elevation angle of maximal gain with respect to a normal to the AISA;

where $\gamma \equiv k_0(n_0\rho - x\sin\theta_0)$;

$k_o$ is a radiation's free-space wavenumber at a design frequency;

$n_o$ is a surface wave's refractive index averaged over the scalar impedance pattern;

and $\rho = \sqrt{x^2+y^2}$;

where $$\tan\phi \equiv \frac{y}{x};$$

where the ± sign corresponds to the AISA operating in a right hand circularly polarized (RHCP) or left hand circularly polarized (LHCP) modes, respectively; and where X and M vary with ρ, the distance from the surface-wave source.

26. The circularly polarized artificial impedance surface antenna (AISA) of claim 25 wherein M increases monotonically with ρ.

27. A method of fabricating a circularly polarized artificial impedance surface antenna (AISA) comprising:

forming an impedance modulated substrate having a modulated scalar impedance to a surface wave traversing a top surface of the substrate;

wherein the modulated scalar impedance pattern is $$Z(x, y) = X + M\left(\frac{\sin\gamma\cos\phi}{\cos\theta_0} \pm \cos\gamma\sin\phi\right);$$

where X is the mean impedance;

where M is the modulation amplitude;

where $\theta_0$ is the elevation angle of maximal gain with respect to a normal to the AISA;

where $\gamma \equiv k_0(n_0\rho - x\sin\theta_0)$;

$k_o$ is a radiation's free-space wavenumber at a design frequency;

$n_o$ is a surface wave's refractive index averaged over the scalar impedance pattern;

and $\rho = \sqrt{x^2+y^2}$;

where $$\tan\phi \equiv \frac{y}{x};$$

where the ± sign corresponds to the AISA operating in a right hand circularly polarized (RHCP) or left hand circularly polarized (LHCP) modes, respectively; and where X and M vary with ρ, the distance from the surface-wave source.

28. The method of claim 27 wherein M increases monotonically with ρ.

* * * * *